US007456583B2

(12) United States Patent
Yao et al.

(10) Patent No.: US 7,456,583 B2
(45) Date of Patent: Nov. 25, 2008

(54) ELECTRICAL CIRCUIT WITH DUAL STAGE RESONANT CIRCUIT FOR IGNITING A GAS DISCHARGE LAMP

(75) Inventors: Xiaoli Yao, Shanghai (CN); Rajendra Kumar Pokharna, Columbia, MD (US); Viktor Karoly Varga, Solon, OH (US); Chao Yang, Shanghai (CN); Yingqi Zhang, Shanghai (CN)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 11/469,926

(22) Filed: Sep. 5, 2006

(65) Prior Publication Data

US 2008/0054819 A1 Mar. 6, 2008

(51) Int. Cl.
*H05B 37/02* (2006.01)

(52) U.S. Cl. ..... 315/224; 315/291; 315/307

(58) Field of Classification Search ..... 315/209 R, 315/216–219, 223–226, 246, 248, 258, 262–264, 315/272, 276, 283–284, 291, 307
See application file for complete search history.

(56) References Cited

U.S. PATENT DOCUMENTS

| | | | | |
|---|---|---|---|---|
| 5,367,227 | A | 11/1994 | Gademann et al. | 315/290 |
| 5,416,387 | A * | 5/1995 | Cuk et al. | 315/209 R |
| 5,534,753 | A | 7/1996 | Blom et al. | 315/244 |
| 5,677,602 | A * | 10/1997 | Paul et al. | 315/224 |
| 5,680,015 | A * | 10/1997 | Bernitz et al. | 315/291 |
| 5,892,332 | A | 4/1999 | Drews et al. | 315/209 CD |
| 5,894,202 | A | 4/1999 | Betz et al. | 315/289 |
| 6,072,710 | A * | 6/2000 | Chang | 363/132 |
| 6,075,327 | A | 6/2000 | Albou | 315/307 |
| 6,144,171 | A | 11/2000 | Clements et al. | 315/289 |
| 6,181,081 | B1 | 1/2001 | Hirschmann et al. | 315/289 |
| 6,188,180 | B1 | 2/2001 | Diamond | 315/289 |
| 6,232,726 | B1 * | 5/2001 | Janczak | 315/224 |
| 6,337,800 | B1 * | 1/2002 | Chang | 363/37 |
| 6,583,585 | B2 | 6/2003 | Takeda et al. | 315/291 |

(Continued)

FOREIGN PATENT DOCUMENTS

EP 0933977 A2 8/1999

(Continued)

OTHER PUBLICATIONS

J. David Irvin (Basic Engineering Circuit Analysis, second edition book, chapter 8, p. 298).*

*Primary Examiner*—David Hung Vu
*Assistant Examiner*—Tung X Le
(74) *Attorney, Agent, or Firm*—Paul J. DiConza

(57) ABSTRACT

A circuit such as may be used for igniting and operating a gas discharge lamp is provided. The circuit includes a resonant circuit connected to receive a variable voltage output signal from an inverter. The resonant circuit includes a first circuit stage and a second circuit stage. The second circuit stage includes a resonant tank circuit configured to generate a resonant output voltage when a switching frequency of the inverter matches a resonant frequency of the resonant circuit. The first circuit stage includes at least one current-suppressing element for reducing an effect of a resonant current that flows in the resonant circuit on a switching current that flows in the inverter.

20 Claims, 1 Drawing Sheet

U.S. PATENT DOCUMENTS

| | | | | |
|---|---|---|---|---|
| 6,891,336 | B1 * | 5/2005 | Mita | 315/224 |
| 7,053,561 | B2 * | 5/2006 | Mayer et al. | 315/209 R |
| 2002/0121867 | A1 * | 9/2002 | Mita et al. | 315/219 |
| 2005/0088113 | A1 * | 4/2005 | Ushijima et al. | 315/276 |
| 2007/0145905 | A1 * | 6/2007 | Van Der Voort | 315/209 CD |
| 2007/0188111 | A1 * | 8/2007 | Taipale | 315/291 |

FOREIGN PATENT DOCUMENTS

| | | |
|---|---|---|
| EP | 0933976 B1 | 3/2000 |
| EP | 1056315 B1 | 7/2003 |
| EP | 1056314 B | 9/2003 |
| JP | 2002329 | 11/2002 |

* cited by examiner

ELECTRICAL CIRCUIT WITH DUAL STAGE RESONANT CIRCUIT FOR IGNITING A GAS DISCHARGE LAMP

FIELD OF THE INVENTION

The present invention is generally related to electrical circuits, and, more particularly, to a circuit with a dual stage resonant circuit, such as may be used to ignite a gas discharge lamp.

BACKGROUND OF THE INVENTION

It is known that in lighting ignition circuits for igniting a gas discharge lamp, such as an automotive high intensity discharge (HID) headlamp, the ignition voltage may be obtained by pulse-forming networks, such as single stage resonant circuits. A resonant output pulse can be directly (or through transformer coupling) applied to supply igniting energy to the lamp.

A variable voltage output from an inverter circuit is commonly used to drive the resonant circuit. A required high voltage can be obtained by the resonant circuit when the switching frequency of the inverter matches the resonant frequency of the resonant circuit. One known disadvantage of this type of ignition circuit is that a relatively large resonant current is formed in the single resonant stage and this current can flux into the power switches of the inverter. This causes relatively large power losses and increases the cost and volume of the circuit in order to dissipate the resulting thermal load. Thus, it is desirable to provide an ignition circuit that in a cost-effective manner addresses the foregoing issues.

BRIEF DESCRIPTION OF THE INVENTION

Generally, the present invention fulfills the foregoing needs by providing in one aspect thereof a circuit for electrically driving a load, such as a gas discharge lamp, in at least two distinct modes of operation, such as a lamp ignition mode and a steady-state mode of operation of the lamp. The circuit may comprise an inverter including a plurality of power switches set to operate at a first switching frequency during a first mode of operation to supply a variable voltage output signal. The circuit may further comprise a resonant circuit connected to receive the variable voltage output signal from the inverter. The resonant circuit comprises a first circuit stage and a second circuit stage, and the second circuit stage includes a resonant tank circuit configured to generate a resonant output voltage when the first switching frequency of the inverter matches a resonant frequency of the resonant circuit. The first circuit stage comprises at least one current-suppressing inductor for reducing an effect of a resonant current in the resonant circuit on a switching current in the inverter.

BRIEF DESCRIPTION OF THE DRAWINGS

These and other advantages of the invention will be more apparent from the following description in view of the drawings that show.

DETAILED DESCRIPTION OF THE INVENTION

The inventors of the present invention have innovatively recognized a lighting ignition circuit for igniting and then operating (e.g., during steady state operation) a gas discharge lamp, such as an automotive high intensity discharge (HID) headlamp. The circuit includes a dual stage resonant circuit that in one aspect thereof allows effective utilization of a single inverter both during an ignition mode of a gas discharge lamp, and then during steady state operation of the lamp, (e.g., to drive the lamp during normal operation after ignition has been completed). One of the circuit stages advantageously serves as a current-suppression stage. Consequently, a resonant current Ir that forms in the resonant circuit is prevented from fluxing into the inverter and as a result the magnitude of a switching current in the inverter is relatively small when compared to the resonant current Ir. This aspect should bring advantages, such as lower voltage stress for the semiconductor power switches in the inverter, and reduced power losses and higher efficiency of the entire circuit.

Figure 1:
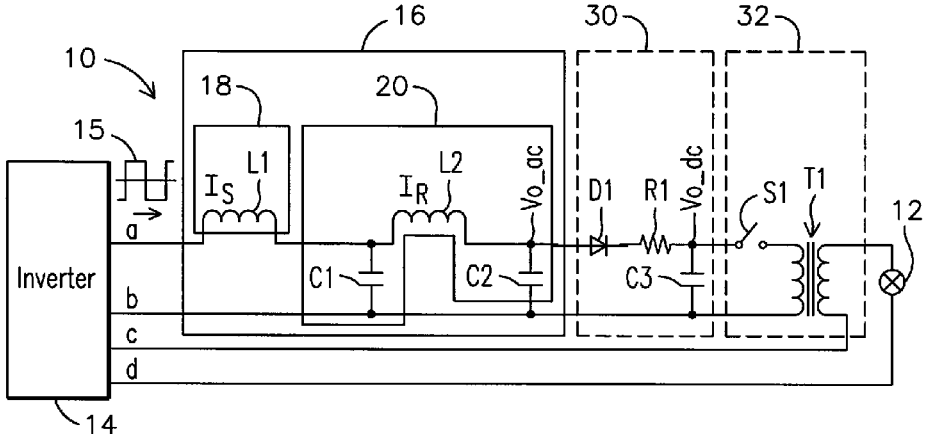
FIG. 1 is a block diagram of an electrical circuit embodying aspects of the present invention, as may be used for igniting a gas discharge lamp.

FIG. 1 is block diagram of an example embodiment of an electrical circuit 10 for igniting and (upon completion of a lamp ignition event) driving a gas discharge lamp 12, such as an automotive high intensity discharge (HID) lamp, metal halide HID lamp, and other kinds of HID lamps. It will be appreciated that a circuit embodying aspects of the present invention can be used for high voltage applications other than for igniting a gas discharge lamp. An example of such other application may be a step-up power supply, e.g., ionizers, chargers, etc. Accordingly, although the description below focuses on a lighting application, such description should be viewed as an example and should not be construed in a limiting sense.

In one example embodiment, circuit 10 comprises an inverter 14, such as a full bridge inverter, half bridge inverter, class-D inverter, etc. The inverter comprises a plurality of power switches set to operate at a first switching frequency during a lamp ignition mode and outputs a variable voltage signal 15, e.g., a square wave signal. The inverter is connected to a resonant circuit 16 embodying aspects of the present invention. More particularly, resonant circuit 16 comprises a first circuit stage 18 including in one example embodiment an inductor L1. This inductor functions during the ignition mode as a current-suppressing element for reducing an effect of a resonant current in the resonant circuit on a switching current in the inverter. The input signal to first circuit stage 18 is the variable voltage signal 15 supplied by inverter 14. For readers desirous of general background information regarding examples of inverter architectures reference is made to textbook titled "Power Electronics Circuits, Devices and Applications, $2^{nd}$ Ed., by M. H. Rashid, which textbook was published by Prentice-Hall, Inc., and is herein incorporated by reference.

Resonant circuit 16 further comprises a second circuit stage 20 including in one example embodiment an inductor L2, a first capacitor C1 and a second capacitor C2 connected to form a tank resonant circuit. In one example embodiment, the resonant frequency f is defined by the following equation: f=1/(2*3.14*sqrt(L2*C)), where C=C1*C2/(C1+C2). In one example embodiment, L1=0.47 mH, L2=0.525 mH, C1=0.044 uF, C2=2.2 nF. In this example embodiment, the resonant frequency will be f=150 kHz. And in this example embodiment the switching frequency can be set to about 150 kHz during the ignition phase, and then the switching frequency can be changed to a value in the order of several hundreds Hz during steady state operation when used to drive a lamp such as an automotive HID headlamp, etc.

When the switching frequency of inverter 14 is set to match the resonant frequency, a high resonant voltage is generated across the second capacitor C2 being that the capacitance value of the second capacitor C2 s chosen to be substantially smaller relative to the capacitance value of the first capacitor C1. It is noted that in a two stage circuit embodying aspects of the present invention, the resonant current Ir essentially flows just through inductor L2, and first and second capacitors C1, and C2, but does not flow through the current-suppressing inductor L1 being that the inductance value of the first inductor L1 comprises a relatively small inductance value and L1 effectively acts as a current suppressor. Consequently, the resonant current Ir advantageously cannot flux into the inverter circuit, and as a result the magnitude of the switching current of the inverter circuit is relatively small when compared to the resonant current Ir.

In one example embodiment, the resonant output voltage (Vo_ac) can be optionally rectified by a rectifier circuit 30 to a DC voltage by a diode rectifier D1 connected to a resistor R1 and a third capacitor C3, which stores the resonant peak voltage. The DC voltage from third capacitor C3 (Vo_dc) may be connected to a voltage pulse circuit 32 (e.g., an ignition module) to actuate a switch S1, and then transfer the electrical energy stored in third capacitor C3 to a high voltage (HV) transformer T1 to ignite the lamp. It will be appreciated that switch S1 is used as a generic representation of various examples of switching means, such as a spark gap, break down diode, sidac, thyristor, insulated gate bipolar transistor (IGBT), metal oxide semiconductor field effect transistor (MOSFET), relay, etc.

At the secondary side of HV transformer T1, a high voltage pulse (e.g., >25 kv) will be generated so that lamp 12 is ignited. It is contemplated that in this example embodiment ignition circuit 10 can realize a hot re-strike of HID lamp 12. After an ignition event is executed, during steady state operation the lamp will be directly supplied a drive signal by inverter 14, such as conceptually represented by connecting wires c and d. The switching frequency of the inverter circuit can be set from a first value suitable for the ignition phase to a second frequency value suitable for the steady state operation of the lamp. In the foregoing example embodiment, the lamp is triggered by DC voltage (e.g., uni-polar voltage, Vo_dc)). In operation, this circuit embodiment can supply very high DC ignition voltage (e.g., >25 kV) for the lamp, and during steady state operation can supply a lower voltage suitable for normal operation of the lamp. This circuit embodiment may be used in applications where high re-restrike (e.g., >25 kv) and uni-polar voltage ignition of a HID lamp is desired, such as for automotive HID headlamps. It will be appreciated that the connecting wires a, b, c, and d can be adapted to two or three wire connecting arrangements based, for example, on the circuit architecture of the inverter circuit.

It will be appreciated that in another example embodiment, that does not use rectifier 30, the resonant output voltage (Vo_ac) from the resonant circuit can be directly connected to voltage pulse circuit 32 to trigger switch S1. In this case, the energy stored in second capacitor C2 is transferred to the primary winding of HV transformer T1 to ignite the lamp. After an ignition event is executed, during steady state operation the lamp will be supplied a drive signal by inverter 14 through connecting wires c and d. The switching frequency of the inverter circuit can be adjusted from a first value suitable for the ignition phase to a second value suitable for the steady state operation of the lamp. In the foregoing example embodiment, the lamp is triggered by AC voltage (e.g., bi-polar voltage). This circuit embodiment can supply very high AC ignition voltage (e.g., >25 kV) for the lamp, and during steady state operation can supply a lower voltage suitable for normal operation of the lamp. This circuit embodiment may be used in applications where the HID lamp needs a high re-strike with bi-polar voltage ignition. It will be appreciated that the connecting wires a,b,c,d can be combined to two or three wire connecting arrangements based, for example, on the circuit architecture of the inverter circuit.

In yet another example embodiment, the resonant output voltage from the resonant circuit 12 can be directly applied to the lamp without use of either a rectifier 30 and a voltage pulse circuit 32. In this case, the lamp will be triggered by AC voltage (e.g., bi-polar voltage, Vo_ac). This circuit embodiment can supply high ignition voltage (e.g., several kV) for triggering the lamp. After an ignition event is executed, during steady state operation the lamp will be also directly driven by AC voltage (e.g., bi-polar voltage, Vo_ac). The switching frequency of the inverter can be adjusted from a first value suitable for the ignition phase to a second value suitable for the steady state operation of the lamp. The circuit embodiment may be suitable for applications where the HID lamp does not need a hot re-strike.

In view of the foregoing description of example embodiments, it should be appreciated that rectifier circuit 30 and/or voltage pulse circuit 32 constitute optional circuitry (as represented by the dashed line blocks in FIG. 1) that may be used based on the needs of a given lighting ignition application.

Figure 2:
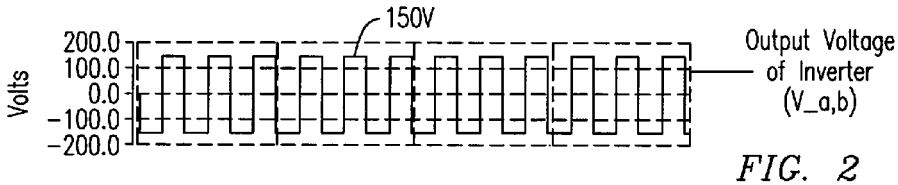
FIGS. 2-4 show respective plots of example waveforms that may be used for illustrating principles of operation of the circuit of FIG. 1.
Figure 3:
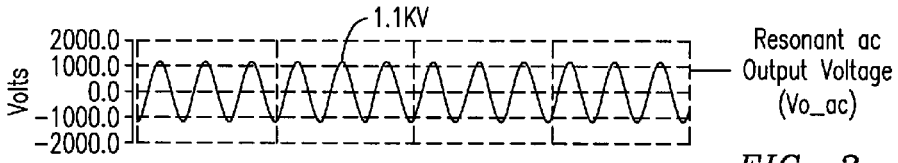
Figure 4:
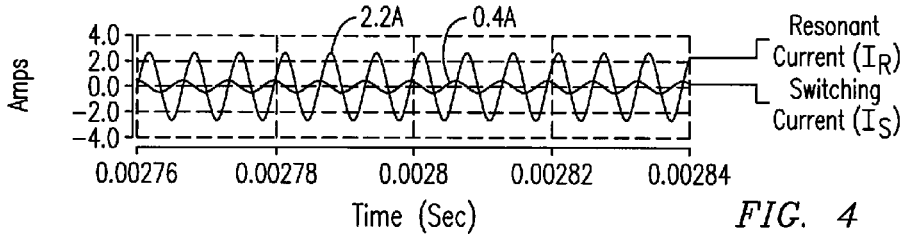

FIGS. 2-4 show respective plots of example waveforms that may be used for illustrating operation of the circuit of FIG. 1.

FIG. 2 is a plot of an example square wave from inverter 14 as may be used to excite the two-stage resonant circuit.

FIG. 3 is a plot of an example resonant output voltage (Vo_ac) as may form across second capacitor C2.

FIG. 4 is a plot that illustrates example waveforms of a resonant current (Ir) and a switching current (Is). Note at least an example five-fold reduction in the amplitude of the switching current with respect to the resonant current.

While the preferred embodiments of the present invention have been shown and described herein, such embodiments are provided by way of example only. Numerous variations, changes and substitutions will occur to those of skill in the art without departing from the invention herein. Accordingly, it is intended that the invention be limited only by the spirit and scope of the appended claims.

We claim as our invention:

1. A circuit for igniting and operating a gas discharge lamp, the circuit comprising:

an inverter comprising a plurality of power switches set to operate at a first switching frequency during a lamp ignition mode to supply a variable voltage output signal; and a resonant circuit connected to receive the variable voltage output signal from the inverter, wherein said resonant circuit comprises a first circuit stage and a second circuit stage, and further wherein the second circuit stage includes a resonant tank circuit configured to generate a resonant output voltage when the switching frequency of the inverter matches a resonant frequency of the resonant circuit, and wherein the first circuit stage comprises at least one current-suppressing element for reducing a fluxing effect of a resonant current that flows in the resonant circuit on a switching current that flows in the inverter, said flux-reducing effect occurring when the switching frequency of the inverter matches the resonant frequency of the resonant circuit, wherein the resonant current essentially flows just through the second circuit stage.

2. The circuit of claim 1 wherein the resonant output voltage from the resonant circuit is directly applied to the lamp to cause ignition of the lamp.

3. The circuit of claim 1 further comprising a rectifier circuit connected to receive the resonant output voltage from the resonant circuit to generate a rectified output voltage.

4. The circuit of claim 3 further comprising an ignition module comprising a transformer selectively connected by way of a switch to the rectifier circuit through a primary winding to receive the rectified voltage, and thereby generate an unipolar voltage pulse applied to the lamp through a secondary winding of the transformer.

5. The circuit of claim 1 further comprising an ignition module comprising a transformer selectively connected by way of a switch to the resonant circuit through a primary winding to receive the resonant output voltage, and thereby generate a bipolar voltage pulse applied to the lamp through a secondary winding of the transformer.

6. The circuit of claim 1 wherein the second circuit stage comprises first and second capacitors and an inductor, wherein the first capacitor is connected in parallel circuit with the second capacitor and the inductor therein, and the second capacitor stores the resonant output voltage.

7. The circuit of claim 6 wherein the resonant frequency of the resonant circuit is defined by the following equations:

$$f = \frac{1}{2 \times \pi \times \sqrt{L \times C}}$$

wherein $$C = \frac{C1 \times C2}{C1 + C2},$$

and further wherein Cl and C2 correspond to the capacitance values of the first and second capacitors in the second circuit stage and L corresponds to the inductance value of the inductor therein.

8. The circuit of claim 1 wherein the current-suppressing element in the first circuit stage comprises an inductor with a first terminal connected to an output terminal of the inverter and a second terminal connected in parallel circuit to the first capacitor of the second circuit stage and the inductor therein.

9. The circuit of claim 1 wherein upon completion of a lamp ignition event the inverter is set to operate at a second switching frequency to supply a variable voltage signal for driving the lamp during steady state operation.

10. A circuit for electrically driving a load in at least two distinct modes of operation, the circuit comprising:

an inverter comprising a plurality of power switches set to operate at a first switching frequency during a first mode of operation to supply a variable voltage output signal; and a resonant circuit connected to receive the variable voltage output signal from the inverter, wherein said resonant circuit comprises a first circuit stage and a second circuit stage, and further wherein the second circuit stage includes a resonant tank circuit configured to generate a resonant output voltage when the set first switching frequency of the inverter matches a resonant frequency of the resonant circuit, and wherein the first circuit stage comprises at least one current-suppressing inductor for reducing a fluxing effect of a resonant current in the resonant circuit on a switching current in the inverter, said flux-reducing effect occurring when the first switching frequency of the inverter matches the resonant frequency of the resonant circuit, wherein the resonant current essentially flows just through the second circuit stage.

11. The circuit of claim 10 wherein the load comprises a gas discharge lamp and the first mode of operation comprises a lamp ignition mode of operation.

12. The circuit of claim 11 wherein the resonant output voltage from the resonant circuit is directly applied to the lamp to cause ignition of the lamp.

13. The circuit of claim 11 further comprising a rectifier circuit connected to receive the resonant output voltage from the resonant circuit to generate a rectified output voltage.

14. The circuit of claim 13 further comprising an ignition module comprising a transformer selectively connected by way of a switch to the rectifier circuit through a primary winding to receive the rectified voltage, and thereby generate an unipolar voltage pulse applied to the lamp through a secondary winding of the transformer.

15. The circuit of claim 11 further comprising an ignition module comprising a transformer selectively connected by way of a switch to the resonant circuit through a primary winding to receive the resonant output voltage, and thereby generate a bipolar voltage pulse applied to the lamp through a secondary winding of the transformer.

16. The circuit of claim 11 wherein the second circuit stage comprises first and second capacitors and an inductor, wherein the first capacitor is connected in parallel circuit with the second capacitor and the inductor therein, and the second capacitor stores the resonant output voltage.

17. The circuit of claim 16 wherein the resonant frequency of the resonant circuit is defined by the following equations:

$$f = \frac{1}{2 \times \pi \times \sqrt{L \times C}}$$

wherein $$C = \frac{C1 \times C2}{C1 + C2},$$

and further wherein Cl and C2 correspond to the capacitance values of the first and second capacitors in the second circuit stage and L corresponds to the inductance value of the inductor therein.

18. The circuit of claim 11 wherein the current-suppressing inductor in the first circuit stage comprises a first terminal connected to an output terminal of the inverter and a second terminal connected in parallel circuit to the first capacitor of the second circuit stage and the inductor therein.

19. The circuit of claim 11 wherein upon completion of a lamp ignition event the inverter is set to operate at a second switching frequency to supply a variable voltage signal for driving the lamp in a second mode of operation, wherein the second mode of operation comprises steady state operation of the lamp.

20. A circuit for igniting and operating a gas discharge lamp, the circuit comprising:

a resonant circuit connected to receive a variable voltage output signal from an inverter, wherein said resonant circuit comprises a first circuit stage and a second circuit stage, and further wherein the second circuit stage includes a resonant tank circuit configured to generate a resonant output voltage when a switching frequency of the inverter matches a resonant frequency of the resonant circuit, and wherein the first circuit stage comprises at least one current-suppressing element for reducing a fluxing effect of a resonant current that flows in the resonant circuit on a switching current that flows in the inverter, said flux-reducing effect occurring when the switching frequency of the inverter matches the resonant frequency of the resonant circuit, wherein the resonant current essentially flows just through the second circuit stage.

* * * * *

UNITED STATES PATENT AND TRADEMARK OFFICE

CERTIFICATE OF CORRECTION

PATENT NO. : 7,456,583 B2
APPLICATION NO. : 11/469926
DATED : November 25, 2008
INVENTOR(S) : Yao et al.

It is certified that error appears in the above-identified patent and that said Letters Patent is hereby corrected as shown below:

In Column 5, Line 39, in Claim 7, delete “Cl” and insert --C1--, therefor.

In Column 6, Line 45, in Claim 17, delete “Cl” and insert --C1--, therefor.

Signed and Sealed this

Twenty-fourth Day of February, 2009

John Doll

JOHN DOLL
*Acting Director of the United States Patent and Trademark Office*